United States Patent [19]

Sasaki et al.

[11] Patent Number: 4,678,029

[45] Date of Patent: Jul. 7, 1987

[54] EVAPORATING HEAT TRANSFER WALL

[75] Inventors: Toshi Sasaki, Hitachiota; Hiromichi Yoshida; Shigeho Fukuda, both of Hitachi; Kiyoshi Oizumi, Tsuchiura; Kimio Kakizaki, Hitachi; Wataru Nakayama, Kashiwa; Takahiro Daikoku, Ushiku; Tadakatsu Nakajima, Shimoinayoshi; Yoshihiko Nakayama, Sakura, all of Japan

[73] Assignees: Hitachi Cable, Ltd.; Hitachi, Ltd., both of Tokyo, Japan

[21] Appl. No.: 652,294

[22] Filed: Sep. 19, 1984

[30] Foreign Application Priority Data

Sep. 19, 1983 [JP] Japan ..... 58-172810

[51] Int. Cl.[4] ..... F28F 13/18; F28F 19/02

[52] U.S. Cl. ..... 165/133; 165/911; 62/527

[58] Field of Search ..... 165/133, DIG. 14; 62/527

[56] References Cited

U.S. PATENT DOCUMENTS

| | | | |
|---|---|---|---|
| 3,454,081 | 7/1969 | Kun et al. . | |
| 3,566,514 | 3/1971 | Szumigala | 165/133 |
| 3,768,290 | 10/1973 | Zatell | 165/133 |
| 3,906,604 | 9/1975 | Kakizaki et al. . | |
| 4,438,807 | 3/1984 | Mathur et al. | 165/133 |

FOREIGN PATENT DOCUMENTS

| | | | |
|---|---|---|---|
| 0009160 | 1/1977 | Japan | 165/133 |
| 0011464 | 1/1977 | Japan | 165/133 |
| 0014260 | 2/1977 | Japan | 165/133 |
| 0016048 | 2/1977 | Japan | 165/133 |
| 0016766 | 2/1979 | Japan | 165/133 |
| 57-31080 | 7/1982 | Japan . | |
| 0035394 | 2/1983 | Japan | 165/133 |

*Primary Examiner*—William R. Cline
*Assistant Examiner*—John K. Ford
*Attorney, Agent, or Firm*—A. Thomas S. Safford

[57] ABSTRACT

In a heat transfer wall having a number of fine and elongate tunnels adjacent to each other with a minute distance under the surface thereof being in contact with liquid on the heat transfer wall, and a number of fine openings for communicating the tunnels to the outside thereof defined on ceilings of the tunnels along the longitudinal directions thereof with each minute distance, a tongue-like projection is provided which protrudes from an edge of the opening or vicinity of the opening across the opening 1 whereby a flow of fluid passing through the openings provided with the projections is controlled so that heat transfer performance characteristics are improved.

19 Claims, 9 Drawing Figures

EVAPORATING HEAT TRANSFER WALL

BACKGROUND OF THE INVENTION

1. Field of the Invention

This invention relates to an evaporating heat transfer wall and particularly to an improved evaporating heat transfer wall which can advantageously transfer heat to liquid by evaporating (in a wide meaning including boiling) the liquid being in contact with the heat transfer wall.

2. Description of the Prior Art

A heat transfer wall has been proposed by Japanese Patent Publication No. 44357/1981 for advantageously transferring heat to a liquid from the surface of a plate or tube. The liquid, such as Freon, when in contact with the surface is evaporated therefrom. The heat transfer wall has a number of fine elongate tunnels adjacent to each other which are formed a minute distance under the surface of said wall. A number of fine openings in the ceilings of said tunnels for communicating the tunnels with the outside are regularly spaced by minute distances along the ceiling of each of said tunnels.

Such heat transfer wall as described above can achieve higher heat transfer performance than that of a heat transfer wall in which slit-like narrow openings are continuously defined along tunnels. However, a heat transfer wall having much higher heat transfer performance has recently been required, because of miniaturization, high-performance and the like of air conditioning apparatus or freezing apparatus etc. in which such heat transfer walls are utilized.

SUMMARY OF THE INVENTION

Accordingly, it is an object of the present invention to provide an improved evaporating heat transfer wall having excellent heat transfer performance.

In accordance with the present invention, such object can be attained by disposing a tongue-like projection protruding from an opening or a vicinity of the opening to be directed inside the opening in the above described conventional heat transfer wall, and subjecting fluid passing through the opening provided with the projection to the control of flow (called "traffic control" hereinafter) by means of such projection.

Figure 1:
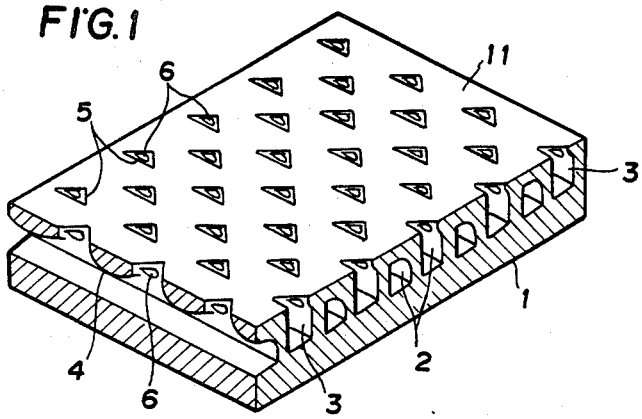
FIG. 1 is a perspective view illustrating outline of an embodiment of a heat transfer wall according to the present invention.
Figure 3:
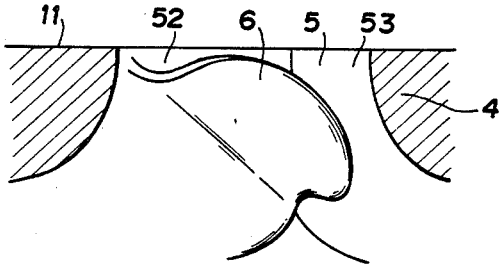

FIGS. *2a, 2b* and *2c* are enlarged plan views each showing an example of an opening in the heat transfer wall of FIG. 1;

FIG. 3 is a sectional view taken along line III—III of FIG. *2a;*

Figure 4:
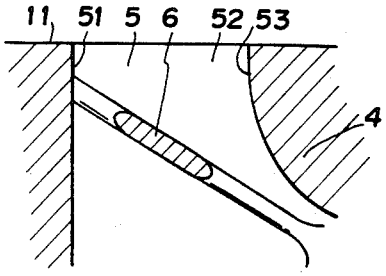

FIG. 4 is a sectional view taken along line IV—IV of FIG. *2a;*

Figure 5:
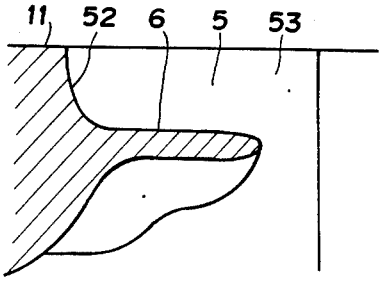

FIG. 5 is a sectional view taken along line V—V of FIG. *2a;*

Figure 6:
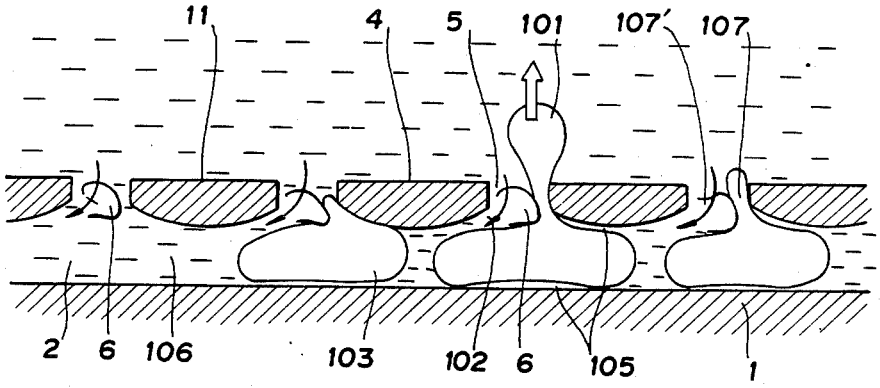
Figure 7:
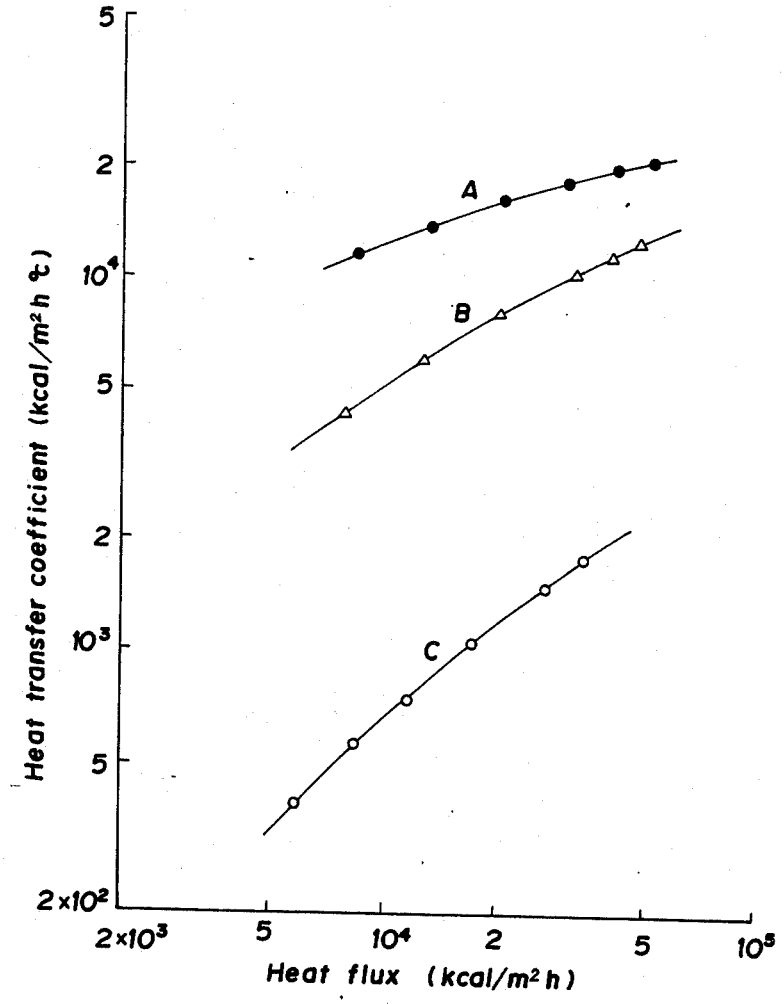

FIG. 6 is an explanatory view showing boiling condition of the heat transfer wall according to the present invention; and FIG. 7 is a graph indicating heat transfer characteristics of an embodiment of the heat transfer wall according to the present invention.

DESCRIPTION OF THE EMBODIMENTS

The present invention will be described hereinbelow by referring to the accompanying drawings.

FIG. 1 illustrates a case wherein the invention is applied to the outer surface of a tubular member. In FIG. 1, reference numeral 2 designates fine tunnels each defined on the surface of a tubular member 1 (called "heat transfer wall" hereinafter) made of, for example, copper having a height of 0.2–1.0 mm and a width of approximately 0.1–1.0 mm. Such a tunnel is adjacent to another tunnel with a pitch of approximately 0.2–1.5 mm and continued spirally with a nearly right-angled inclination with respect to axis of the tube. Reference numeral 3 designates walls each being integrated with the tubular member 1 and partitioning the tunnels 2. The upper part of the wall 3 is thickened partially along the tunnel 2 as is apparent from the section on the right side of FIG. 1. A ceiling 4 is formed integrally with the walls 3. Fine openings 5 are regularly defined on the ceiling 4 with a pitch of approximately 0.3–1.0 mm along the tunnels 2. Each opening 5 is of a substantially triangular shape as shown in FIG. *2a* and of a size in which an inscribed circle of approximately 0.1–0.4 mm in diameter can be accommodated two-dimensionally. The shape of the fine opening 5 is not limited to a triangular one, but a circular, square, oval or similar shape may also be adopted. The central portion of the inside of the ceiling portion 4 between the openings 5 along the tunnel 2 is thicker than other portions and continues to the thickened portion of the wall 3 as shown in the section on the left side of FIG. 1, so that there is a wavy configuration along the ceiling 4. Thus each tunnel 2 has partially differentiated sectional areas along its longitudinal direction so that at the position of each opening 5 the tunnel 2 has a slightly larger sectional area than that at the other positions. On the other hand, the ceiling 4 may alternatively be flat at the inside thereof so that the section of each tunnel 2 may substantially be uniform.

In each opening 5, tongue-like projection 6 (which is smaller than the area of the opening 5) is formed as shown in FIG. *2a*. The projection 6 protrudes from a side 52 which is one of two sides of the opening 5 intersecting a side 51 thereof parallel to the tunnels 2 and extending toward a side of the wall 3 so as to partially interrupt the opening 5 two-dimensionally. As shown in FIG. *2b* or *2c*, the projection 6 may be formed which is divided at the extreme end thereof or which is provided with a plurality of tongues at the end thereof, or the projection 6 may be also shaped as concave, convex or similar configuration. Furthermore, the projection 6 is inclined at an angle of 5–80 degrees on the side 52 of the opening 5 and becomes lower three-dimensionally at the intersecting point of the sides 52 and 53 than at the intersecting point of the sides 51 and 52 as shown in FIGS. 3 to 5, inclusive. Such inclination of the projection 6 may be formed along different directions. The projection 6 may be also formed in such a manner that the root thereof is substantially parallel to or perpendicular to the outer surface 11 or the extreme end thereof is twisted. As is same with the case mentioned hereinunder, it is not required that the root of the projection 6 is clearly defined unlike those as illustrated in the drawings, but the profile thereof may be continuously drawn by a straight or curved line, or the combination thereof. Of course, it is also not necessary that thickness of the projection 6 is substantially uniform in the entire length thereof unlike those typically illustrated in FIGS. 3 to 5. Accordingly, the inclination of the projection 6 as described above defines a narrow gap 7 between the side of the opening 5 and the projection 6. The narrow gap 7 is uneven along the projection 6 two- or three-dimensionally and distinguishes a fleeing path of vapor bubbles from a liquid supplying path in each opening portion 5 with respect to its tunnel 2, so that it is advantageous for traffic control of flow of both the bubbles and the liquid. Such unevenness of the narrow gap 7 may also be obtained from difference in shape of the projection 6 in respect of the opening 5, or deviation in positions of the projection 6 in respect of the opening 5. The difference in thickness of the edges of the projection 6 and/or the opening 5 results in the same effect. In these cases, the projection 6 will not be required to have any inclination with respect to an outer surface 11, but it is desirable in the case where the projection 6 has no inclination that the root of the projection 6 is approximately 0.1–0.4 mm below the outer surface 11.

Furthermore the projection may extend not only in the opening 5, but also in its tunnel 2 at a portion thereof. Optionally, the projection 6 may not be projected from the edge of the opening 5, but rather from a part of the wall close to the opening so that the projection 6 faces to the opening 5. Even in such cases as mentioned above, it is preferable to give inclination to the projection 6 so as to allow the deviation of the narrow gap 7 with respect to the opening 5, thereby affording unevenness to the narrow gap 7.

As described above, various combinations may be realized between the opening 5 and the projection 6, but it is preferable that a ratio of area of the upper surface (the side facing to the outside) of the projection 6 with respect to area of the opening 5 is within a range of approximately 20–150%.

In operation, when the heat transfer wall 1 having a surface skin area of the construction as described above is heated at a higher temperature than that at which liquid being in contact with the heat transfer wall 1 boils, vapor bubbles 103 are generated in the tunnel 2 as shown in FIG. 6.

It is to be noted that the cross sectional view illustrating situation of boiling in FIG. 6 exhibits the case where the heat transfer wall 1 is moderately heated. On the other hand, when the overheating is significant, the overall tunnel 2 is filled with the vapor bubbles 103 so that the bubbles become continuous. When pressure of the vapor bubbles 103 in the tunnel 2 exceeds stable conditions for gas-liquid interface (which are essentially determined in accordance with surface tension of liquid and dimension of the gap 107) in a narrow gap 107 the vapor bubbles 103 are partly released outside the heat transfer wall 1 as bubbles 101. On one hand, external liquid is supplied to the tunnel 2 through the narrow gap 107′ in accordance with capillary action of liquid as well as pressure change in the tunnel 2 which is caused by growth or release of the bubbles 101 in the narrow gap 107. A thin liquid film 105 is formed between each vapor bubble 103 in the tunnel 2 and the inside thereof. Since the liquid film 105 is very thin (approximately 10–50 μm), there is hardly any temperature drop in the film. In these circumstances, when liquid is slightly overheated by the wall of the tunnel, the liquid evaporates instantly and vapor is supplied to the vapor bubbles 103. On the other hand, since external liquid 102 to be supplied is introduced into the tunnel 2 after once colliding against the projection 6, the liquid is preheated by the projection part 6 and flows into the tunnel 2 as overheated liquid. The liquid thus flowed evaporates by slight overheating so that the liquid supplies vapor to the vapor bubbles 103. Moreover the direction of flow of the liquid flowing into the tunnel 2 is changed by the projection 6 towards the longitudinal direction of the tunnel 2 as indicated by arrow 102, so that the liquid is smoothly supplied to the liquid film 105. In such a case, the fluid flow resistance of the liquid increases at the time when the liquid passes through the projection 6 so that the amount of the liquid to be supplied into the tunnel 2 is controlled.

Since the narrow gap 7 functions in such a manner that the bubbles 101 grow in and are released from the part 107 thereof in which the fluid resistance is small while the liquid is supplied from the part 107′ in which the fluid resistance is larger, gas-liquid exchange between the inside and outside of the tunnel is simultaneously performed in traffic-controlled condition so that boiling phenomenon is smoothly and quasi-constantly effected.

As shown in FIG. 6, if overheating is slight on the heat transfer wall 1, vapor pressure in the tunnel 2 decreases so that a large amount of liquid flows into the tunnel 2 and the vapor bubbles 103 becomes crushable. However, since the projection 6 functions as a throat and compartmentalizes the tunnel 2 to divide the same, a part 106 in which the vapor bubble is crushed does not extend over the whole area in the tunnel 2 so that the part 106 remains in only a small area. As a result, the vapor bubbles 103 and the thin liquid films 105 are maintained in most part of the tunnel 2. In this case, the wavy pattern of the ceiling 4 along the tunnel 2 aids the above-mentioned effects.

As described above, high heat transfer coefficient is obtained by such function that a stable liquid film is formed in the tunnels 2. Particularly, the heat transfer coefficient is remarkably improved in a region where a heat transfer wall is slightly overheated (a region of small heat flux).

Figure 2A:
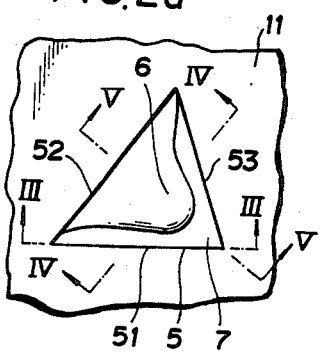

In an embodiment of the present invention, a tunnel having a height of 0.45 mm at the higher position and 0.3 mm at the lower position as well as a width of 0.25 mm was spirally formed immediately under the surface skin of a copper tube of an outer diameter of 18 mm and a thickness of 1.1 mm with 0.5 mm pitch in a nearly right-angled inclination with respect to axis of the tube. In this case, the surface skin under which the tunnel is defined was flattened except for the openings. Furthermore substantially triangular openings, each being of size by which an inscribed circle of a diameter of 0.2 mm is accomodated and a side thereof being parallel to a wall partitioning tunnels, were defined on ceilings at the larger cross sectional area in the tunnel with 0.8 mm pitch. Inside each of the openings, a small projection having its root on the side 52 and being smaller than the opening in two dimensions as shown in FIG. 2*a* was formed, and the projection was inclined in such a way that a side of intersection of the sides 52 and 53 is lowered at an angle of about 45 degrees as shown in FIGS. 3 to 5.

External boiling heat transfer performance characteristics were determined in respect of the heat transfer tube fabricated in the above embodiment by using trichlorofluoromethane ($CFCl_3$) under condition of an absolute pressure of 0.41 kg/mm$^2$. The results are shown in FIG. 7 wherein line A indicates characteristic curve of the copper tube according to the present invention, line B indicates characteristic curve of a copper tube having substantially same external appearance with that of the present invention, but no tongue-like projection in each opening, and line C indicates characteristic curve of a copper tube the surface of which is flattened and which has no tunnel.

As mentioned above, the heat transfer wall according to the present invention can further improve its heat transfer performance by providing projections in openings for communicating fine tunnels to the outside thereof, so that the present invention has such an advantage of being capable of contributing miniaturization and high-performance of apparatus in which the heat transfer wall of the invention is utilized.

The method of making this type of heat transfer wall with triangular openings, but without the projections taught by the present application, has been previously described in U.S. Pat. No. 3,906,604, see also Japanese Patent Publication No. 54-16766. Thus, as a first step in making the aforementioned preferred example, a copper pipe having the diameter of 18 mm, with a wall thickness of 1.1 mm, has a spiral V-shaped grooving shallowly rolled into the copper tubing surface at substantially right angles to the axis of the tube. As will be readily understood by those skilled in the art, this extremely fine V-shaped grooving forms what are to become two of the three sides (namely, sides 52 and 53) of the triangular shaped holes 5. Thus, diamentionally, the fine grooving in the illustrative example is of a depth to have inscribed therein a circle having a diameter of 0.2 mm and a pitch between the grooves of 0.8 mm.

Next, as a second step, a deeper spiral groove is gouged across the initial more-shallow grooving, thereby forming the base and sides 3 of the tunnels 2. As indicated in U.S. Pat. No. 3,906,604, this gouging-type grooving is preferably fashioned by a cutting tool of the "plow-up" type wherein the material which was formerly lying flat on the surface of the copper pipe is plowed out and rolled up into an upstanding spiral rib, the top of which rib now has V-shaped notches (formed from the first shallow grooving). The resulting rows of ribs would be as illustrated in FIG. 1 in Japanese Patent Publication No. 54-16766 (except that the notches 3*a* and 4*a* in the ribs 2 as identified in that publication are of equal depth as shown in the preferred embodiment of the present invention and in U.S. Pat. No. 3,906,604).

The final step in the prior art consists of brushing or rolling over the tops of the saw-tooth shaped ribs, so that the teeth of the saw tooth pattern form the roof 4 of the tunnel 2. The initial grooving forms the triangular holes 5, as previously explained, with the third side 51 being formed by the back wall of the adjacent rib.

Figure 2B:
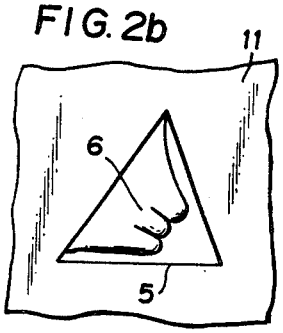
Figure 2C:
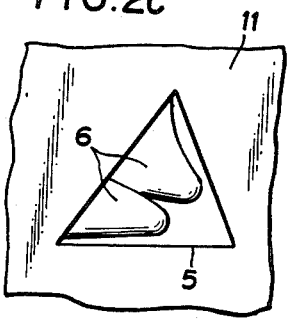

Thus, FIG. 1 of U.S. Pat. No. 3,906,604 and FIG. 1 of the present application show essentially identical structure, except that the triangular holes in the patent lack the projections 6 taught by the present application. In the patent, the surface is indicated as having been wire brushed rather then rolled, as alternatively taught therein, while the structure in FIG. 1 of the present application and in FIGS. 2 and 3 of Japanese Patent Publication No. 54-16766 are shown with the smoother rolled surface.

In the methods taught by U.S. Pat. No. 3,906,604 and in Japanese Patent Publication No. 54-16766, the second cross gouging step is done with a sharp tool which cut cleanly across the initial grooving leaving clean notches in the tops of the plow-up ribs. However, from the prior description of the present invention, it will be readily appreciated that in order to have a projection 6 extending from one of the sides 52 of the initial shallow grooving, the gouging tool can be so constructed as to wipe some material across the shallower grooving, thus forming the projection at the same time as the ribs are plowed up.

It will be further understood that merely by adjusting the depth of the grooving, and therefore, the height of the ribs and the shape of the initial grooving, the angle of inclination of the projection 6 and the shape of the holes 5 can thereby be varied.

Referring again to the preferred example, to give holes 5 a pitch of 0.5 mm, the gouging tool will plow up ribs which are spaced one from another by 0.5 mm. In order to have tunnels 3 which have a width of 0.25 mm, the gouging tool will plow the cross grooving with a width of 0.25 mm.

By reference to the method disclosed in U.S. Pat. No. 3,906,604, it will be found that the dimensions of the present application are within those taught in that patent.

While the tunnel has spirally and continuously been defined in the above embodiment, linearly or link-shaped tunnel or tunnels may also be defined. Of course, the heat transfer wall of the present invention is not only limited to a tubular member, but it may be applied to cylindrical, plate and the like members. Furthermore the material of the heat transfer wall was copper in the aforesaid embodiment, but other metallic or nonmetallic materials may also be utilized.

Although the above embodiment has been described in connection with the case where the heat transfer wall is immersed in liquid and then, the liquid is boiled, i.e., the case of pool boiling condition, the present invention may be applied to any of applications in which liquid is evaporated in the form of this film, i.e., the liquid is dropped or sprayed on the heat transfer wall, and the thin film of liquid is then evaporated. In such modified applications, it has been also confirmed that the same high heat transfer performance can be achieved as in the aforesaid embodiment.

Other modifications of the present invention may occur to those skilled in the art based upon a reading of the present disclosure. Those are intended to be included within the scope of the present invention.

We claim:

1. In an evaporating heat transfer wall having a number of fine and elongate tunnels adjacent to each other and positioned a minute distance under the wall surface, a number of discrete small longitudinally spaced openings for communicating said tunnels to the outside of said wall by extending from the ceilings of said tunnels to the wall surface, the improvement comprising each opening being substantially triangular in shape when viewed along a vertical axis oriented normal to the surface of said heat transfer wall, and a tongue-like projection protruding from an edge wall of each opening or a vicinity of such opening to extend across said opening leaving an unevenly dimensioned narrow gap.

2. An evaporating heat transfer wall as claimed in claim 1 wherein said tongue-like projection has inclination with respect to the surface of said heat transfer wall.

3. An evaporating heat transfer wall as claimed in either of claims 1 or 2 wherein each respective tongue-like projection protrudes from an edge wall of said substantially triangular opening.

4. An evaporating heat transfer wall as claimed in claim 1 or 2 wherein the ceilings of said tunnels have a wavy configuration, and said openings are positioned at larger cross sectional areas in said tunnels.

5. An evaporating heat transfer wall as claimed in claim 1 or 2 wherein said heat transfer wall is of a tubular shape, and said tunnels extend spirally along the axis of the tube.

6. An evaporating heat transfer wall as claimed in claim 1, wherein said gap, when viewed along a vertical axis oriented normal to the surface of said heat transfer wall, is substantially V-shaped having a broad area at the base of the V and a relatively narrow area at each leg of the V.

7. An evaporating heat transfer wall as claimed in claim 3 wherein the ceilings of said tunnels have a wavy configuration, and said openings are positioned at larger cross sectional areas in said tunnels.

8. An evaporating heat transfer wall according to claim 4, wherein said heat transfer wall is of a tubular shape, and said tunnels extend spirally along the axis of the tube.

9. In an evaporating heat transfer wall having a number of fine and elongate tunnels adjacent to each other and positioned a minute distance under the wall surface, a number of small longitudinally spaced openings for communicating said tunnels to the outside of said wall by extending from ceilings of said tunnels to the wall surface, the improvement comprising a tongue-like projection projecting from an edge of each opening or a vicinity of such opening to extend across said opening leaving a narrow gap, wherein each said opening is substantially triangular in shape when viewed along a vertical axis oriented normal to said heat transfer wall surface, and wherein an edge of each said opening is parallel to a wall defining its respective tunnel and is positioned at a common vertical line with said wall of said tunnel, and said tongue-like projection protrudes from one of the remaining two edges of said opening.

10. An evaporating heat transfer wall as claimed in claim 9 wherein the ceilings of said tunnels have a wavy configuration, and said openings are positioned at larger cross sectional areas in said tunnels.

11. An evaporating heat transfer wall as claimed in claim 10 wherein said heat transfer wall is of a tubular shape, and said tunnels extend spirally along the axis of the tube.

12. An evaporating heat transfer wall as claimed in claim 9 wherein said heat transfer wall is of a tubular shape, and said tunnels extend spirally along the axis of the tube.

13. An evaporating heat transfer wall having a number of fine and elongate tunnels adjacent to each other and positioned a minute distance under the wall surface, a number of discrete small closely spaced openings for communicating said tunnels to the outside of said wall by extending from the ceilings of said tunnels to the wall surface, a plurality of tongue-like projections protruding convexly when viewed perpendicularly to said heat transfer wall surface, and each projection associated with and extending from an edge wall of a respective opening or a vicinity of such opening to extend across said opening leaving a continuous gap having at least one first gap portion and at least one second gap portion which second gap portion is dimensionally narrower than said first gap portion and which has relatively higher resistance to fluid flow than said first gap portion such that vapor bubbles formed in the tunnel preferentially pass through said first gap portion and liquid can simultaneously enter said tunnel by capillary action through said second gap portion, the upper and lower surfaces of each tongue-like projection being inclined in the same general direction relative to the surface of said heat transfer wall within a range of from 5 to 80 degrees.

14. An evaporating heat transfer wall as claimed in claim 13, wherein said tunnels are from 0.2 to 1.0 mm high, approximately 0.1 to 1.0 mm wide, have a pitch of approximately 0.2 to 1.5 mm, said openings are triangular and of a size to inscribe a circle of approximately 0.1 to 0.4 mm in diameter, and said openings have a pitch along said tunnels of approximately 0.3 to 1.0 mm.

15. An evaporating heat transfer wall as claimed in claim 14, wherein the ratio of the area of the upper surface of each of said projection to the area of its respective opening ranges from approximately 20 to 150%.

16. An evaporating heat transfer wall as claimed in claim 13 wherein the ceilings of said tunnels have a wavy configuration, and said openings are positioned at large cross sectional areas in said tunnels.

17. An evaporating heat transfer wall as claimed in claim 13 wherein said heat transfer wall is of a tubular shape, and said tunnels extend spirally along the axis of the tube.

18. An evaporating heat transfer wall having a number of fine and elongate tunnels adjacent to each other and positioned a minute distance under the wall surface, a number of discrete small closely spaced openings for communicating said tunnels to the outside of said wall by extending from the ceilings of said tunnels to the wall surface, and a plurality of tongue-like projections protruding convexly when viewed perpendicularly to said heat transfer wall surface, and each projection extending from an edge wall of each respective opening or a vicinity of such opening to extend across said opening leaving a continuous gap having at least one first gap portion and at least one second gap portion which second gap portion is dimensionally narrower than said first gap portion and which has relatively higher resistance to fluid flow than said first gap portion such that vapor bubbles formed in the tunnel preferentially pass through said first gap portion and liquid can simultaneously enter said tunnel by capillary action through said at least one second gap portion, a single tongue-like projection extending across each respective opening forming a substantially crescent shaped gap.

19. An evaporating heat transfer wall as claimed in claim 18, wherein said projection has no inclination and the root of the projection is spaced approximately 0.1 to 0.4 mm below the other surface of said wall.

* * * * *